US011905654B2

(12) United States Patent
Wang et al.

(10) Patent No.: US 11,905,654 B2
(45) Date of Patent: Feb. 20, 2024

(54) STEEL CORD WITH A BRASS COATING ENRICHED WITH IRON PARTICLES

(71) Applicant: NV BEKAERT SA, Zwevegem (BE)

(72) Inventors: Baoxing Wang, Jiangyin (CN); Yunfang Tang, Jiangyin (CN); Yohann Hamon, Bondues (FR)

(73) Assignee: NV BEKAERT SA, Zwevegem (BE)

( * ) Notice: Subject to any disclaimer, the term of this patent is extended or adjusted under 35 U.S.C. 154(b) by 208 days.

(21) Appl. No.: 17/423,673

(22) PCT Filed: Jan. 27, 2020

(86) PCT No.: PCT/EP2020/051847
§ 371 (c)(1),
(2) Date: Jul. 16, 2021

(87) PCT Pub. No.: WO2020/156967
PCT Pub. Date: Aug. 6, 2020

(65) Prior Publication Data

US 2022/0112656 A1 Apr. 14, 2022

(51) Int. Cl.
*D07B 1/06* (2006.01)
*C22C 9/04* (2006.01)
(Continued)

(52) U.S. Cl.
CPC ..... *D07B 1/0666* (2013.01); *B21C 23/08* (2013.01); *C22C 9/04* (2013.01); *C25D 3/20* (2013.01);
(Continued)

(58) Field of Classification Search
None
See application file for complete search history.

(56) References Cited

U.S. PATENT DOCUMENTS 4,255,496 A 3/1981 Haemers
4,265,678 A 5/1981 Hachisuka et al.
(Continued)

FOREIGN PATENT DOCUMENTS

EP 3 363 933 8/2018
GB 983932 A * 2/1965
(Continued)

OTHER PUBLICATIONS

International Search Report and Written Opinion of the International Searching Authority dated May 7, 2020, in International (PCT) Application No. PCT/EP2020/051847.
(Continued)

*Primary Examiner* — Seth Dumbris
(74) *Attorney, Agent, or Firm* — Wenderoth, Lind & Ponack, L.L.P.

(57) ABSTRACT

A steel cord that is suitable for reinforcing rubber articles such as tires. The inventive steel cord enables to completely eliminate the presence of cobalt in a tire when combined with the proper cobalt free compound. Advantageously the steel cord adheres equally well to rubbers containing organic cobalt salts. The inventive wire is different from prior art steel cords in that the brass coating now comprises iron particles. The iron particles have a size between 10 nm and 10 000 nm. The presence of iron mitigates the adhesion retention loss of the rubber to steel cord bond in a hot and humid environment. It is a further advantage that the inventive steel cord does not contain any intentionally added cobalt thereby contributing to the elimination of harmful substances in the production area as well as the environment.

13 Claims, 7 Drawing Sheets

Figure 1A:
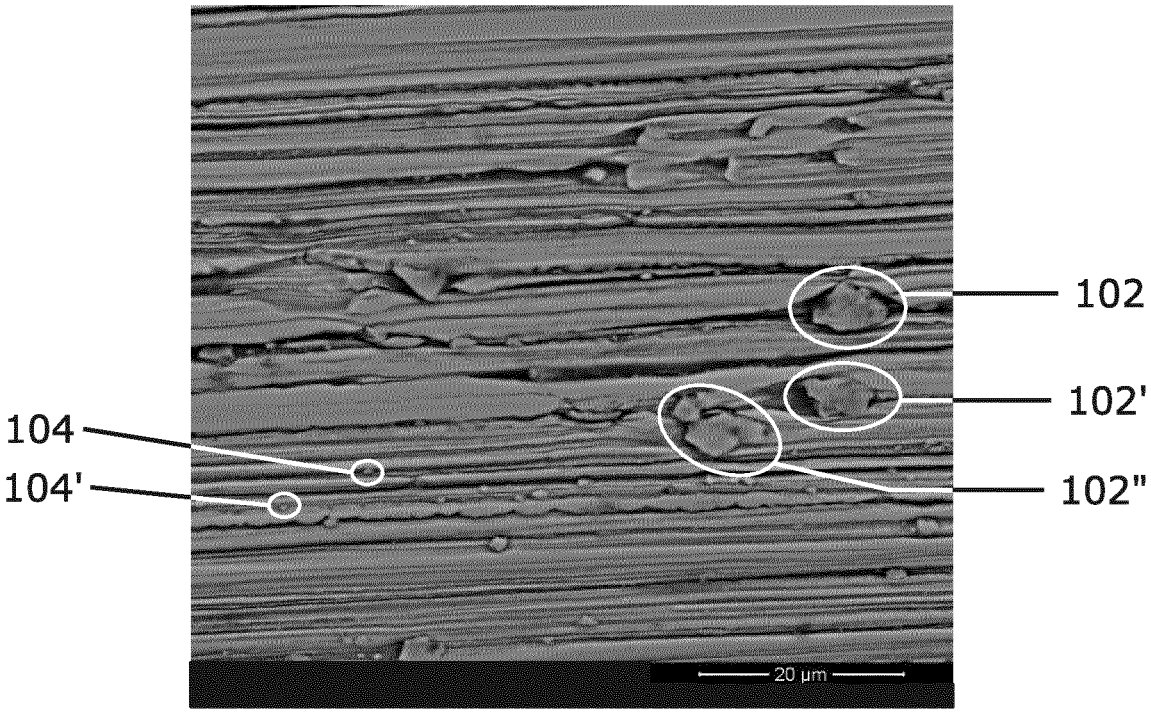

(51) Int. Cl.

| | |
|---|---|
| ***B21C 23/08*** | (2006.01) |
| ***C25D 3/20*** | (2006.01) |
| ***C25D 3/22*** | (2006.01) |
| ***C25D 3/38*** | (2006.01) |
| ***C25D 5/10*** | (2006.01) |
| ***C25D 5/50*** | (2006.01) |
| ***C25D 7/06*** | (2006.01) |

(52) U.S. Cl.
CPC ..... *C25D 3/22* (2013.01); *C25D 3/38* (2013.01); *C25D 5/10* (2013.01); *C25D 5/50* (2013.01); *C25D 7/0607* (2013.01); *D07B 2205/3025* (2013.01); *D07B 2205/3089* (2013.01); *Y10T 428/12333* (2015.01)

(56) References Cited

U.S. PATENT DOCUMENTS

| | | | | |
|---|---|---|---|---|
| 4,446,198 | A | 5/1984 | Shemendki et al. | |
| 4,859,289 | A | 8/1989 | Nishimura et al. | |
| 4,883,722 | A * | 11/1989 | Coppens | C23C 22/08 152/565 |
| 8,962,152 | B2 * | 2/2015 | Toyosawa | B60C 9/0007 152/565 |
| 2003/0178117 | A1 | 9/2003 | Oosawa et al. | |
| 2014/0378597 | A1 * | 12/2014 | Buytaert | D07B 1/0666 72/274 |

FOREIGN PATENT DOCUMENTS

| | | |
|---|---|---|
| JP | 2018-119189 | 8/2018 |
| WO | 2011/076746 | 6/2011 |
| WO | 2013/117248 | 8/2013 |
| WO | 2013/117249 | 8/2013 |

OTHER PUBLICATIONS

Bryan Crowther "Rubber-brass bonding", Chapter 6 of the "Handbook of Rubber Bonding", Rapra Technology Limited, of 2001; pp. 163-196, (paragraph [0004] of the application).

W. J. Van Ooij, "Mechanism and Theories of Rubber Adhesion to Steel Tire Cords—An Overview", Rubber Chemistry and Technology, 1984, vol. 57 , pp. 421-456, (in paragraph [0013] of the application).

* cited by examiner

STEEL CORD WITH A BRASS COATING ENRICHED WITH IRON PARTICLES

TECHNICAL FIELD

The invention relates to a steel cord for reinforcing rubber goods such as tires, hoses, conveyor belts and other appliances.

BACKGROUND ART

In 2019 it is projected that about 2 billion steel cord reinforced tires for vehicles will be produced worldwide. The steel cord itself is made of steel filaments coated with a brass coating. The steel and the brass are relatively harmless to the environment and to human health.

However, in order to stabilize the adhesion between the skim compound and the steel cords, tire makers are adding cobalt based organic salts such as e.g. cobalt naphthenate, cobalt stearates or cobalt boron decanoate complexes to the rubber in addition to other additives such as carbon black, sulphur, accelerators, oils, antioxidants, activators, etc. . . .

Some of these cobalt based organic salts are suspected to be carcinogenic and are more and more subject to restricted use.

How the organic cobalt salt functions in the adhesion system has been subject of extensive academic research in which the late W. J. van Ooij played a prominent role. For the purpose of this application his review 'Rubber-brass bonding', Chapter 6 of the 'Handbook of Rubber Bonding', Rapra Technology Limited, of 2001 will be retained as a Basic Reference ('BR'). The growth of dendritic non-stoichiometric cupper sulphide ($Cu_xS$, with x about 1.8) into the rubber network prior and during vulcanisation is believed to be the main adhesion mechanism. This layer is the 'adhesion layer' and is less than 250 nm or even only 100 nm thick.

The organic cobalt salts serve two goals:

- firstly to suppress the growth of the less bonding zinc sulphide (ZnS) thereby favouring the formation of non-stoichiometric dendritic cupper sulphide during bond formation;
- It is generally accepted that the loss in adhesion in hot and humid conditions is due to 'dezincification' of the brass by the diffusion of zinc ions ($Zn^{2+}$) to the adhesion layer forming oxides and hydroxides of zinc and thereby weakening the adhesion layer. A second goal of adding organic cobalt salts is therefore to improve the retention of the steel cord to rubber bond in hot and humid conditions by suppressing this diffusion mechanism;

The drawback is that the organic cobalt salts act as an oxidation catalyst for the diene rubber bonds thereby accelerating rubber aging that can ultimately lead to rubber failure.

In order to avoid the use of organic cobalt salts in the rubber it has been suggested at the end of the seventies of the previous century to incorporate the cobalt into the brass layer of the steel cord rather than into the rubber. See for example U.S. Pat. Nos. 4,255,496 and 4,265,678. Such ternary alloy layers do indeed give very good adhesion retention results in hot and humid conditions. However, they did not allow for the complete elimination of organic cobalt salts out of the rubber. Recent work of the current applicant published in WO 2011/076746, WO 2013/117248, WO 2013/117249 further provided solutions to enable the use of ternary alloy coatings also in cobalt free compounds.

By this technology, the total amount of cobalt incorporated in a single tire when the cobalt is incorporated in the brass coating is reduced to about one fifth to one tenth of the amount of cobalt (as a metal) when mixed as organic cobalt salts in the rubber. This represents a substantial reduction of cobalt use and a lowered burden to the environment.

However, the problem of handling cobalt containing compounds in a production environment has then shifted from the tire maker to the steel cord maker.

Another problem the tire industry faces is that the transition away from using organic cobalt salts in the adhesion rubbers is a major shift in the production strategy complicating the production of a tire. Additional cobalt free rubber mixtures must be introduced and segregation with the conventional rubbers must be absolute.

Furthermore cobalt has become a strategic material in the production of rechargeable batteries as e.g. used in electrical vehicles. Consequently prices of cobalt have soared and the balance between market supply and demand is not expected to reach an equilibrium in the years to come. So eliminating the use of cobalt altogether would not only be beneficial to the environment and solve the operator health issues, but also to the overall price of a tire.

In conclusion: the complete elimination of cobalt out of a tire is beneficial to the price of the tire, for the health of operators and for the environment. Other, less harmful metals than cobalt should therefore be considered.

Based on the interaction of the vulcanisation accelerator in the rubber with the metal surface van Ooij conjectures in BR, page 176: "that all metals that can react with the accelerator should in principle bond to rubber. These metals include the transition metals cobalt, copper, iron, nickel and zinc. Of these copper and cobalt are very active and form strong bonds. The other metals do not bond in practice because the sulphide growth is slow (in the case of iron or zinc), or the metal is passive (in the case of nickel), or the sulphide does not form the dendrites as copper and cobalt do."

Hence, the growth of the sulphide layer on the steel substrate coating is expected to be slower when using iron as a third metal than when using cobalt. However, even in a regular brass coated steel cord, some iron—of the steel substrate—is present at the surface and it has been found that this iron contributes to the adhesion retention and build-up. See page 429 "Mechanism and theories of rubber adhesion to steel tire cords—an overview", W. J. van Ooij, RUBBER CHEMISTRY AND TECHNOLOGY, Volume 57, page 421-456, 1984. Therefore thin brass coatings have improved adhesion properties and adhesion retention. However, the thinness of the brass coating has its limits as still a sufficient amount of copper and zinc must be present at the surface and the filament must be subjected to drawing.

Although the use of a ternary brass-iron alloy for adhesion purposes has been suggested in U.S. Pat. No. 4,446,198, implementation of this coating has never been pursued as other problems impeded its use as will be explained hereinafter.

DISCLOSURE OF INVENTION

The inventors set themselves the task to overcome the problems associated with the prior art. The main object of the invention is to eliminate the use of cobalt in a tire all together. More in particular the inventors have overcome the problems for introducing iron in a brass coating. Furthermore the inventors demonstrate that using a brass coating enriched with iron allows a good initial adhesion and adhesion retention in the common aging tests when using a completely cobalt free rubber compound. The inventors also find that the steel cord coating they suggest equally well performs in cobalt containing rubber compounds thereby alleviating the risk when an exchange of rubbers would accidently occur.

According a first aspect of the invention as summarized in the product claim 1 a steel cord is presented. The steel cord comprises one or more filaments comprising a steel filamentary substrate and coating that partly or totally covers the steel filamentary substrate. The coating comprises brass that—for the purpose of this application—consists of copper and zinc. The coating is enriched with iron. Characteristic of the coating is that the iron is present as particles in the brass, the particles having a size between 10 and 10 000 nanometer.

The steel cord brings to a rubber article such as a tire, hose or belt tensile and compressive strength combined with flexibility. To form a rubber-steel cord composite the filaments are provided with a rubber adherent coating. Filaments can be bundled into a bundle or twisted into a strand. Strands or bundles can on their turn be twisted into a cable. Strands, bundles and cables are collectively referred to as steel cords. As currently single steel filaments—usually referred to as 'monofilaments'—are also considered for the reinforcement of tires a single filament is—for the purpose of this application—also considered a steel cord. In addition the use of the term 'steel cord' does not exclude that other non-steel filaments or filamentary materials are intermingled with the steel filaments. Adding for example organic man-made high performance fibres such as aramid based Twaron® or Kevlar®, or ultra-high molecular weight polyethylene fibre such as Dyneema® may give additional functionalities to the steel cord.

With a 'steel filamentary substrate' is meant an elongated steel element with a length that exceeds its width and thickness dimension, wherein length, width and thickness are oriented mutually orthogonal to one another. For example the length is several kilometer while width and thickness are below one millimeter. The orthogonal cross section of the steel filamentary substrate can be square, rectangular or polygonal but by preference it is round with a diameter 'd'. The diameter of the filament is between 0.10 mm and 0.50 mm. Larger diameters for example between 0.275 and 0.40 mm are mainly used as belt reinforcement of the tire as these filaments are relatively stiff. The filaments are assembled into constructions with few filaments (below 9) or even as a monofilament. Finer filaments such as between 0.10 mm to 0.275 mm assembled into assemblies comprising nine or more filaments are preferably used for the reinforcement of the carcass of a tire. There strength, flexibility and fatigue resistance is more important which can more easily be achieved with finer filaments.

The steel of which the steel filamentary substrate is preferably made of plain carbon steel with a composition within following limits (all percentages are percentages by mass, abbreviated by 'wt %'):

- a carbon content ranging from 0.60 wt % to 1.20 wt %, e.g. 0.80 wt % to 1.1 wt %;
- a manganese content ranging from 0.10 wt % to 1.0 wt %, e.g. from 0.20 wt % to 0.80 wt %;
- a silicon content ranging from 0.10 wt % to 1.50 wt %, e.g. from a 15 wt % to 0.70 wt %;
- a sulphur content below 0.03 wt %, e.g. below 0.01 wt %;
- a phosphorus content below 0.03 wt %, e.g. below 0.01 wt %.

By subjecting the steel to a strain hardening operation like wire drawing filaments with a tensile strength in excess of 2500 MPa or above 3000 MPa or even higher than 3500 MPa can be obtained.

The micro-alloying of steel can help to obtain even higher tensile strength filaments. Mass percentages of the alloying elements are between following limits: chromium: from 0.10 wt % to 1.0 wt %; nickel: from 0.05 wt % to 2.0 wt %, cobalt: from 0.05 wt % to 3.0 wt %; vanadium: 0.05 wt % to 1.0 wt %; molybdenum: from 0.05 wt % to 0.60 wt %; copper: from 0.10 wt % to 0.40 wt %; boron: from 0.001 wt % to 0.010 wt %; niobium: from 0.001 wt % to 0.50 wt %; titanium: from 0.001 wt % to 0.50 wt %; antimony: from 0.0005 wt % to 0.08 wt %; calcium: from 0.001 wt % to 0.05 wt %; tungsten: e.g. in an amount of about 0.20 wt %; zirconium: e.g. in an amount ranging from 0.01 wt % to 0.10 wt %; aluminium: preferably in amounts lower than 0.035 wt %, e.g. lower than 0.015 wt %, e.g. lower than 0.005 wt %; nitrogen: in amounts less than 0.005 wt %; rare earth metals (wt % REM): in amounts ranging from 0.010 wt % to 0.050 wt %.

Micro alloying allows to reach tensile strengths in excess of 3500 MPa, or higher than 3700, even up to and above 4000 MPa.

In an alternative approach, low carbon steels can be used that have been far drawn in order to reach sufficient tensile strength. Typical steel compositions then have a carbon content of less than 0.20 wt %. An example is a carbon content ranging between 0.04 wt % and 0.08 wt %, a silicon content of 0.166 wt %, a chromium content of 0.042 wt %, a copper content of 0.173 wt %, a manganese content of 0.382 wt %, a molybdenum content of 0.013 wt %, a nitrogen content of 0.006 wt %, a nickel content of 0.077 wt %, a phosphorus content of 0.007 wt %, a sulphur content of 0.013 wt %, all percentages being percentages by mass. The ultimate tensile strength of these filaments is considerably lower: above 1200 MPa or even above 1400 MPa, but they have a reduced carbon footprint due to the elimination of intermediate heat treatments.

The steel filamentary substrate is partly or completely covered with a coating. With 'partly covered' is meant that certain regions of the steel filamentary substrate are exposed to the outside. Usually these regions are lengthwise and are due to the wire drawing of the filament. Sometimes they are visible as drawing lines. Possibly but rarely the filamentary substrate will be completely covered with coating.

The coating comprises brass that is enriched with iron. With 'enriched with iron' is meant that the iron does not originate from the filamentary steel substrate. It is iron that has been added to the brass. Characteristic about the iron is that it is present in the coating as particles with a size between 10 and 10 000 nanometer. For the purpose of this application: with the 'size of the particles' is meant the maximum distance between any two points at the surface of the particle.

The inventors have found that the presence of the particles plays an important role in the adhesion of the steel cord to rubber compounds. The presence of iron particles in the brass coating results in a finer grained brass coating. It is conjectured that a finer grained brass coating is better for adhesion build up as through the grain boundaries and the many lattice defects, copper can effectively diffuse during the initial adhesion layer formation. As a result the initial adhesion performance is better compared to that of regular brass coatings. In this respect it is preferred that the iron particles are small and plentiful. Moreover, the resulting lattice structure of the brass wherein iron particles are present results in markedly improved adhesion retention in hot and humid conditions.

At the other end it has been found that the iron particles cannot be too large as this results in processing problems during wet wire drawing. Therefore in a further refined embodiment of the invention, the iron particles have a size between 20 and 5 000 nanometer, or even between 20 and 3000 nanometer, more specifically between 20 and 2000 nanometer, such as between 20 and 1 000 nm.

In a further preferred embodiment some of the iron particles are pressed into the steel filamentary substrate. The iron particles may surface the coating. Some of the iron particles—in particular the larger particles—may show a flattened surface. The shape of the particles is preferably oblate i.e. the particles are flattened, disc shaped rather than needle shaped.

The particles can be observed by the following procedure ('Procedure 1'):

P1(a) An amount of steel cord of about 0.2 gram is cut into pieces of 1 to 2 cm and weighed. The weight W is noted. The pieces are kept in a beaker;

P1(b) Add 10 ml of brass stripping solution into the beaker and keep in ultrasonic bath for five minutes.

The brass stripping solution ('Stripping Solution') comprises 16 g of ammonium persulfate $(NH_4)_2S_2O_8$ with ammonia water $NH_3.H_2O$ in 1 L aqueous solution.

P1(c) Rinse the stripped filament with pure water while holding the filament with a plastic tweezer. Collect the rinsing water into the stripping solution held by the beaker. Dry the stripped filament.

P1(d) For observing the particles, the particles can either be filtered on a paper filter or extracted on a magnet followed by drying in an inert atmosphere.

The particles can be observed preferably by a scanning electron microscope or an optical microscope.

An alternative way to observe the magnitude of the larger (larger than 1000 nm) particles is to detect the iron particles that have been pushed onto the steel filamentary substrate on the dry stripped filament.

The coating of the filament comprises brass. For the purpose of this application brass is an alloy consisting of zinc and copper. It is a substitutional alloy in that copper or zinc atoms may replace each other within the crystal lattice. Within the coating the composition of the brass may vary from almost pure zinc at the radial outer side of the coating to almost pure copper close to the filamentary substrate. Preferably the overall content of copper in the brass is 63 percent by mass or higher taken relative to the total of copper and zinc mass in the coating (excluding any other element in the coating). More preferably the ratio of copper mass in the total of copper and zinc mass is above 65 percent by mass or even above 67 percent by mass. When the amount of copper in the brass is above 63 percent by mass, the formation of beta-(β)-brass is avoided in favour of alpha-(α)-brass. Beta brass is a harder phase of brass and is more difficult to deform.

The amount of iron that is added to the coating is greater than or equal to 1% and smaller than 10% of the total mass of brass and iron. When the mass of iron enrichment is smaller than 1% of the brass and iron mass no improvement in adhesion performance is noticed. When the mass of added iron is larger than 10% the wire becomes difficult to draw.

In a preferred embodiment the amount of iron in the coating is greater than or equal to 2% in mass and smaller than 10% in mass compared to the total mass of brass and iron. In an even more preferred embodiment the amount of iron is between 3 and 9% in mass compared to the total mass of brass and iron.

The amount of iron, copper and zinc in the coating of brass enriched with iron can be measured by means of a second testing procedure ('Procedure 2') that is P2(a) to P2(c)

Follow the steps P1(a) to P1(c) of Procedure 1;

P2(d) Turn the solution in the beaker from alkaline to acid by adding 5 mL of 37% hydrochloric acid HCl and mix the solution in the beaker;

P2(e) Transfer the solution in the beaker to a volumetric flask, cool down to room temperature and dilute with demineralised water to 100 mL;

P2(f) Measure the concentration of iron, copper and zinc in the solution by means of Inductively Coupled Plasma—Optical Emission Spectroscopy (ICP-OES) using standard solutions of (Cu;Fe;Zn) of (0;0;0), (2;0.02;1), (5;0.1;2), (10;0.5;5) mg/L all in a matrix of 10 mL Stripping Solution, 5 mL of 37% HCl per 100 mL of demineralised water;

Preferred ranges for the respective elements in the coating are between 62 and 69 mass percent of copper and between 1 to 10 mass percent of iron the remainder being zinc on the total mass of copper, iron and zinc. Most preferred is that of the total mass of copper, iron and zinc between 62 and 66 mass percent is copper and between 2 to 10, or even between 3 to 9, mass percent is iron the remainder being zinc. One preferred composition is 64 wt % of copper and 8 wt % of iron, the remainder being zinc. The concentration of copper, iron and zinc is measured by means of ICP-OES.

In a further preferred embodiment, the coating is substantially free of iron zinc alloy. Iron zinc alloys form in a number of phases: eta-(η), zeta-(ξ), delta-(δ), Gamma1-($\Gamma_1$) and Gamma-(Γ) phase in increasing amount of iron content. The eta-(η) phase with only 0.03 wt % of iron is still to be regarded as pure zinc, is soft like zinc and is for the purpose of this application not considered an iron zinc alloy. The reason why the presence of iron zinc alloy layers or particles is abhorred is that they have a higher hardness which is disliked during wet wire drawing.

The total amount of coating i.e. the sum of copper, zinc and iron on the filaments of the steel cord relative to the total mass of the steel cord—the mass coating weight (MCW)—is preferably between 1 and 6.5 grams of coating per kg of filament (1 to 6.5 g/kg). More preferred it is between 3 and 5 grams of coating per kg of filament (3 to 5 g/kg), for example between 3.5 and 4 gram of coating per kg of filament (3.5 to 4 g/kg).

In a further preferred embodiment the amount of phosphorous and iron present at the surface of the steel filament is controlled. The amount of phosphorous present at the surface is noted with $P_s$ and is expressed in milligram per square meter ($mg/m^2$), the amount of iron at the surface is noted as $Fe_s$ and is expressed also in $mg/m^2$. The amount of phosphorous and iron present on the surface is determined by mildly etching the surface of the filaments with a weak acid dissolving the phosphorous and the iron according the following measuring procedure (Procedure 3'):

P3(a) weigh about 5 grams of steel cord, cut into pieces of about 5 cm and introduce into a test tube;

P3(b) Add 10 mL of 0.01 Molar hydrochloric acid HCl;

P3(c) Shake sample with acid solution for 15 seconds;

P3(d) Measure the amount of Fe and P present in the solution by ICP-OES;

P3(e) Express the result in mass of Fe and P per unit of surface area of the filamentary steel in milligram per square meter ($mg/m^2$). The result is designated as $Fe_s$ and $P_s$;

The inventors find that best adhesion results are obtained when the amount of phosphorous present on the surface is lower than 4 $mg/m^2$, but larger than zero: $0<P_s\leq 4$ $mg/m^2$. Higher amounts of $P_s$ slow down the growth of the adhesion layer. With a $P_s$ that is lower than 4 $mg/m^2$, the adhesion layer already forms just after the start of the vulcanisation cycle but prior to the start of the cross linking of the rubber. $P_s$ can be lower than 3 $mg/m^2$, or even lower than 1.5 $mg/m^2$.

In a further preferred embodiment, the amount of iron present at the surface $Fe_s$ is larger than or equal to 30 $mg/m^2$ ($Fe_s$ 30 $mg/m^2$). Even more preferred is if more than 35 $mg/m^2$ or even more than 40 $mg/m^2$ of iron is present at the surface. The inventors conjecture that a sufficient amount of iron should be present on the surface of the filaments in order to have sufficient adhesion retention. It is believed that the presence of iron particles at the surface will suppress the diffusion of $Zn^{2+}$ ions towards the adhesion layer and thereby result in an improved adhesion retention in hot and humid conditions as will be demonstrated hereinafter.

By preference the ratio between amount of iron present at the surface of the filament $Fe_s$ and the amount of phosphorous present at the surface of the same filament $P_s$ is larger than 27, or even larger than 30. When this ratio is met, a sufficient amount of iron is present at the surface while the amount of phosphorous is sufficiently low.

As the amount of iron scales with the coating weight, an improved measure for the relative presence of iron is to divide the amount of iron $Fe_s$ present at the surface first by the surface coating weight SCW prior to taking the ratio with the amount of phosphorous $P_s$ present at the surface. The surface coating weight is expressed in grams per square meter ($g/m^2$) in order to remain consistent with the units of $P_s$ and $Fe_s$. The relation between surface coating weight SCW (in $g/m^2$) and mass coating weight (in g/kg) MCW for a filament with diameter 'd' expressed in millimeter 'mm' is:

$$SCW=1.97\times d\times MCW$$

for the steel wires and the coating thicknesses according this invention. By preference the ratio $(Fe_s/SCW)/P_s$ equal to $Fe_s/(SCW\times P_s)$—that is the ratio of $Fe_s$ over the product of $P_s$ and SCW—is larger than 13. Above that value the best results are obtained for adhesion retention. Even better is if the ratio is higher than 14. Values up to 25 can be obtained.

In another preferred embodiment of the invention, the steel cord consists of a single filament. Such a single filament can be used in a tire for example in the bead area as a bead reinforcement or in the belt area as a belt stiffening reinforcement ('monofilament'). Alternatively, a single steel filament according the invention can also be used as a hose reinforcement wire.

According a second aspect of the invention a rubber product comprising vulcanized rubber reinforced with a steel cord according to any one of the above embodiments is claimed. The rubber product can be a tire, for example for a passenger car, a truck, a van or an off-the-road machine. Alternatively, the rubber product can be a hose such as a hydraulic hose, or a belt as for example a conveyor belt, a synchronous belt or an elevator belt. All of these products are manufactured and assembled in the ways known or to be become known in their respective art. The only difference is that the steel cord used for the reinforcement shows a brass coating enriched with iron, wherein the iron is present as particles in the brass coating and wherein the particles have a size between 10 and 10 000 nanometer. It is an advantage of the invention that it is compatible with currently used cobalt containing compounds without adverse effects to the adhesion and adhesion retention.

However, the steel cord has been particularly invented in order to be compatible with adhesion rubber compounds—known as 'skim compounds'—that are substantially free of cobalt or organic cobalt compounds added to the rubber. With 'substantially free' is meant that in the vulcanized rubber the amount of cobalt as detectable by X-Ray fluorescence is below 100 microgram per gram of rubber (0.01 percent Co by mass of rubber, wt %), or below 50 microgram per gram of rubber (0.005 wt % Co) or even below 20 (0.002 wt % Co) or 10 (0.001 wt % Co) microgram per gram of rubber. As normally only the skim compound contains organic cobalt compounds, the analysis is best performed on the rubber in the vicinity of the steel cord for example the remaining rubber that adheres to the steel cord when the steel cord is pulled out of the rubber product. That is the place where one expects the highest concentration of cobalt.

Also the use of the steel cord according to any of the above embodiments for the reinforcement of in a rubber product—preferably a rubber product that is substantially free of cobalt is—claimed.

According a third aspect of the invention, a method to produce a filament of a steel cord as described above is presented. The method comprises the steps of:

(a) Providing an intermediate steel wire having an intermediate diameter 'D': the first intermediate steel wire. The intermediate diameter is selected on the basis of the final filament diameter, the steel composition in particular the carbon content, the final tensile strength to be achieved. Typical sizes are between 0.5 and 3.2 mm;

(b) Electrolytically coating, also called 'electroplating', the intermediate steel wire with copper, iron and zinc. Preferably the metals copper, iron and zinc are coated in layers;

(c) Subjecting the copper-iron-zinc coated intermediate steel wire to a heat treatment to diffuse the zinc into the copper at a temperature of at least 420° C., the melting temperature of zinc. The formation of iron-zinc zeta-(ξ) phase is avoided if the temperature is kept below 530° C.: the iron will not melt and there is no formation of iron-zinc alloy. The temperature must be held for at least 2 seconds in order to enable the zinc to diffuse into the copper, within 10 seconds the diffusion is sufficient. The resulting wire is an intermediate steel wire with a brass coating enriched with iron particles;

(d) Optionally the zinc oxide and iron oxide is removed from the surface of the intermediate steel wire with a brass coating enriched with iron particles. By preference this is done in an acid bath.

Alternatively, the formation of zinc oxide and iron oxide can be avoided by performing the diffusion step (c) in an inert atmosphere such as a nitrogen atmosphere;

(e) Subjecting the intermediate steel wire with a brass coating enriched with iron particles to a wet wire drawing operation thereby obtaining the filament according the invention. The final diameter of the filament will be designated with 'd'.

Characteristic of the invention is that by the wet wire drawing operation, the iron particles as present on the intermediate steel wire with a brass coating enriched with iron particles are diminished to a size of below 10000 nm or 10 μm and are larger than 10 nm.

In a further preferred embodiment of the method the step (b) of electrolytically coating the intermediate steel wire with copper, iron and zinc, is performed in the following order:

(b1) electrolytically coating the intermediate wire with copper;

(b2) electrolytically coating the copper coated intermediate wire with iron;

(b3) electrolytically coating the copper-iron coated intermediate wire with zinc;

Following this order has the advantage that the previously deposited coating will not dissolve in the bath of the subsequently deposited layer.

Step (b2) can be done in any one out the group consisting of the following electrolytic plating solutions:

Ferrous chloride solutions;

Ferrous sulfate solutions;

Ferrous ammonium sulfate solutions;

Ferrous fluoroborate solutions;

Ferrous sulfamate solutions;

Mixed sulfate-chloride baths

In a further preferred embodiment in the step (e)—wherein the intermediate steel wire with a brass coating enriched with iron particles is subjected to a wet wire drawing operation thereby obtaining the filament according the invention—the wire drawing is performed to a true elongation of at least 3.5. The true elongation 'ε' given during wet wire drawing is equal to:

$$\varepsilon=2\cdot\ln(D/d)$$

When the true elongation 'ε' is larger than 3.5, or larger than 3.7 or even larger than 3.9, while even larger than 4 which is currently at the limits what is attainable on steel, the iron particles are elongated, minced, milled to a smaller size than the 10 000 nm or even smaller than 5000 nm e.g. smaller than 3 000 nm or 2 000 nm.

The inventors have found that if the wet wire drawing is performed by means of dies comprising diamond, further advantageous surface properties are induced that increase the adhesion and adhesion retention of the steel cord made of the filaments. Non-exhaustive examples of what is meant with a 'die comprising diamond' are dies made of a single natural diamond, a single artificial diamond, a compact of diamond particles sintered together ('sintered diamonds'), carbonado ('black diamond') or polycrystalline diamonds ('PCD dies').

At least the die determining the final diameter of the filament—called head die—is a die comprising diamond. Alternatively, one, two, three or more dies upward the drawing direction of the wire can also be dies comprising diamond, the remainder of the dies being regular hard metal dies for example tungsten carbide dies. Possibly all dies are dies comprising diamond, although this is generally considered too expensive and not necessary to implement this preferred method of the invention.

BRIEF DESCRIPTION OF FIGURES IN THE DRAWINGS

FIG. 1*a*, shows iron particles originating from the coating that are pressed onto, against the steel substrate.

Figure 1B:
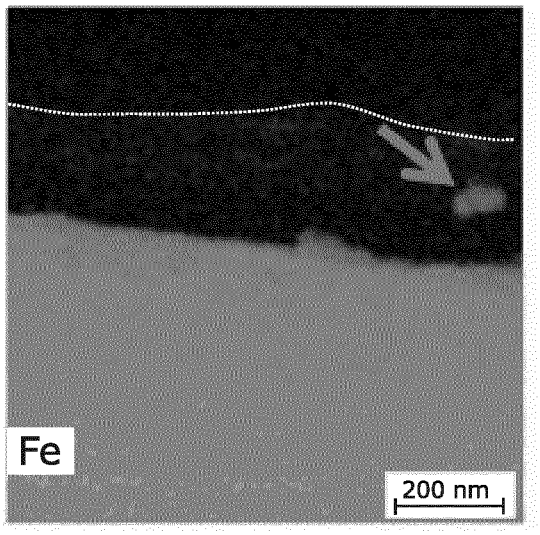

FIG. 1*b* shows an iron particle as present in the brass coating as detected by HAADF-STEM.

Figure 2A:
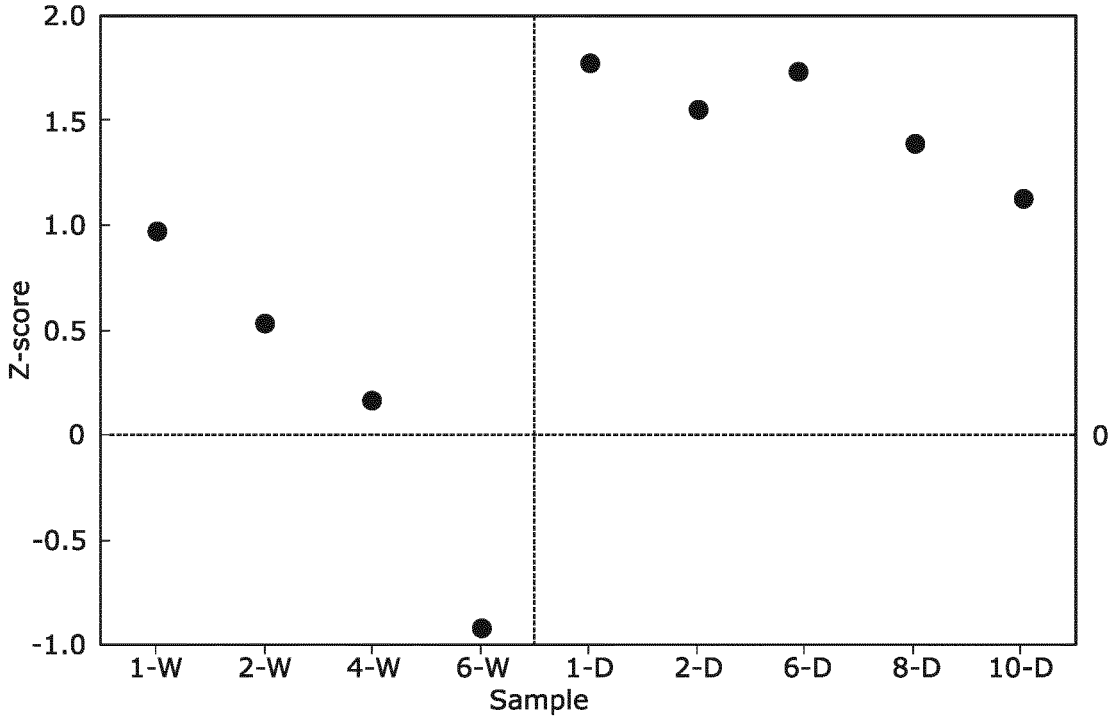

FIG. 2*a* shows the pull out force adhesion results as obtained in Family I compounds in under cure vulcanisation conditions.

Figure 2B:
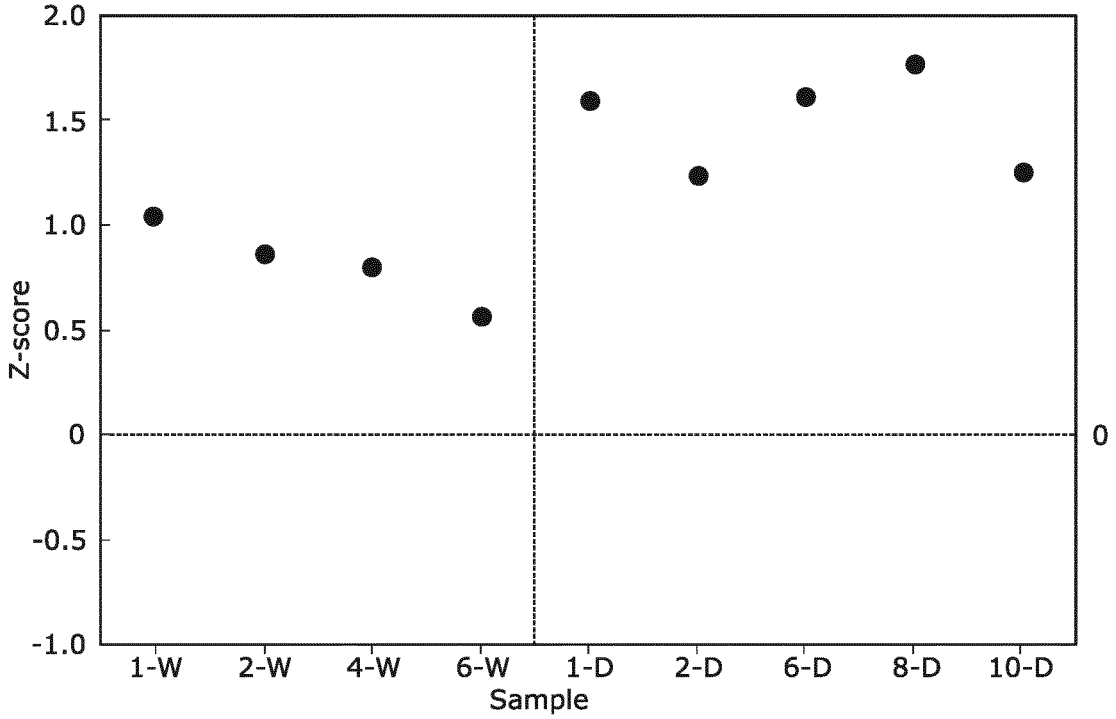

FIG. 2*b* shows the pull out force adhesion results as obtained in Family I compounds in regular cure vulcanisation conditions.

Figure 2C:
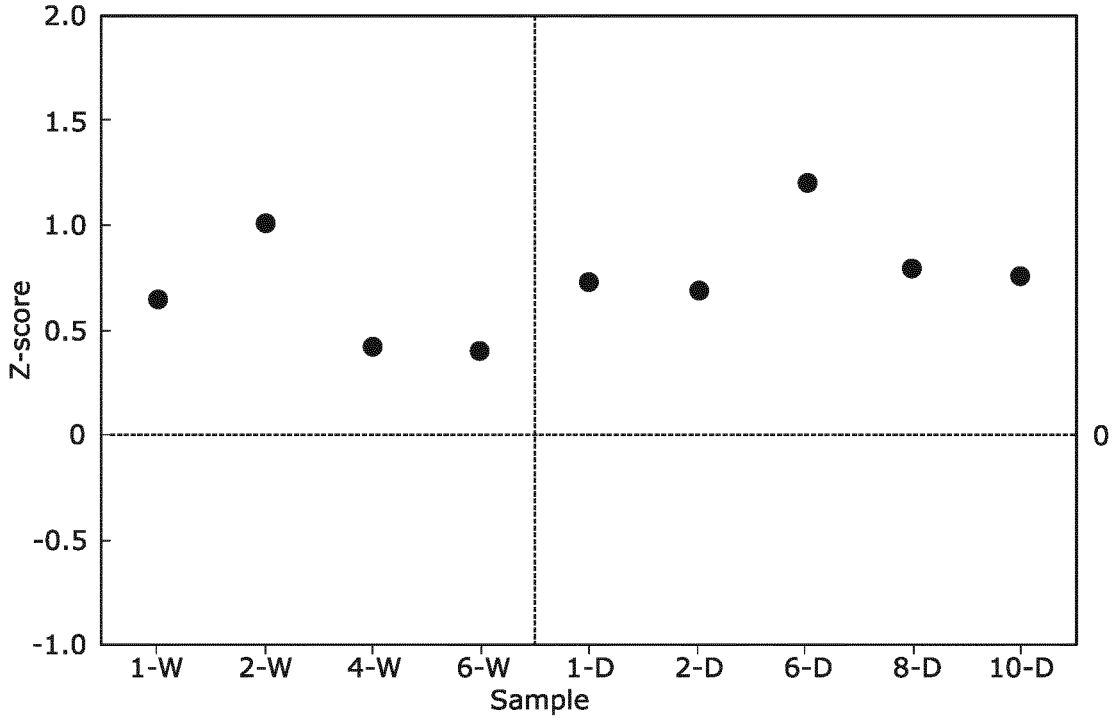

FIG. 2*c* shows the pull out force adhesion results as obtained in Family I compounds in over cure vulcanisation conditions.

Figure 2D:
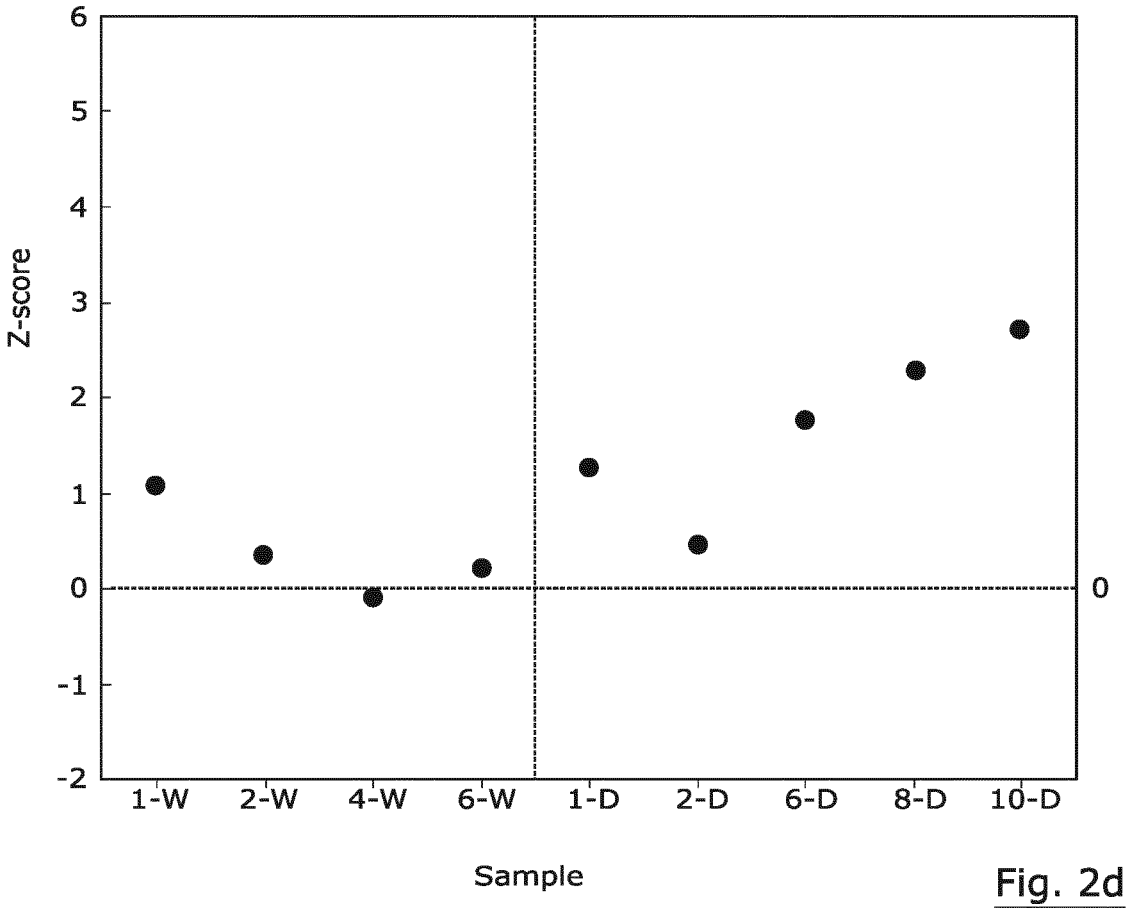

FIG. 2*d* shows the pull out force adhesion results as obtained in Family I compounds after cured humidity aging.

Figure 2E:
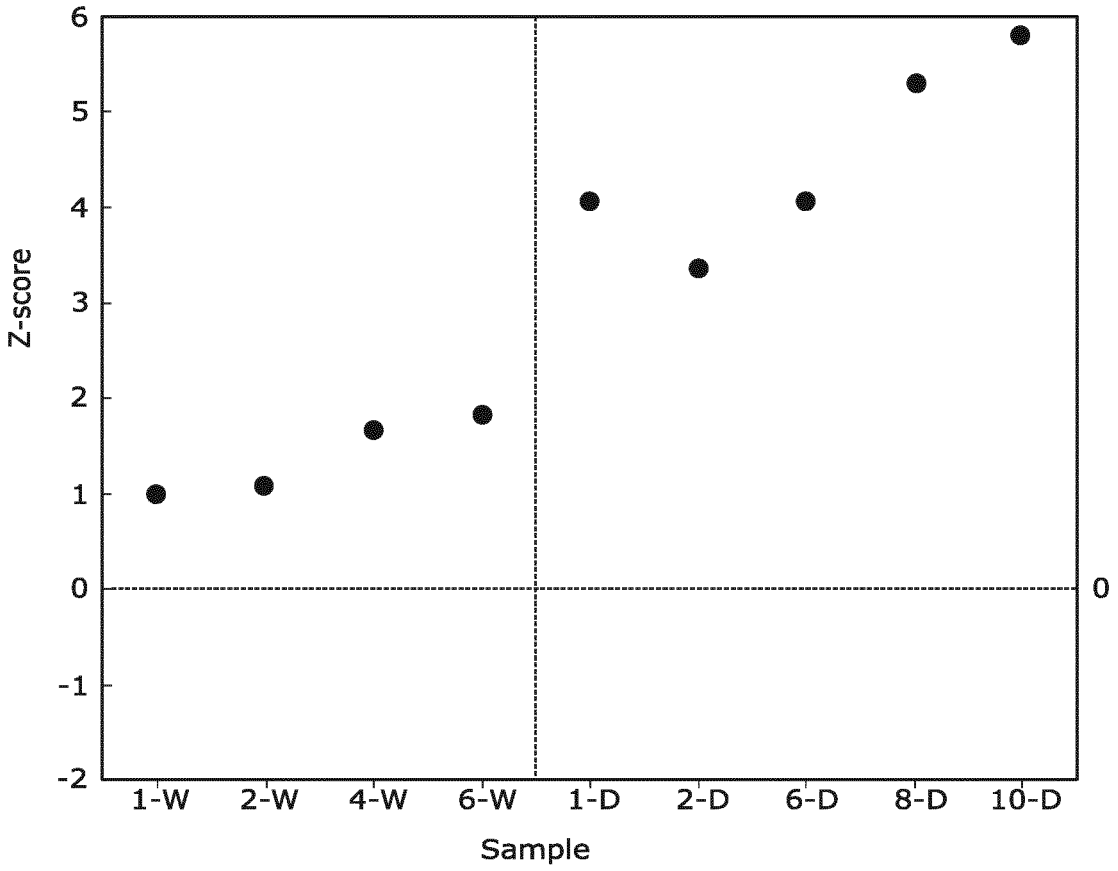

FIG. 2*e* shows the pull out force adhesion results as obtained in Family I compounds after steam aging.

Figure 3A:
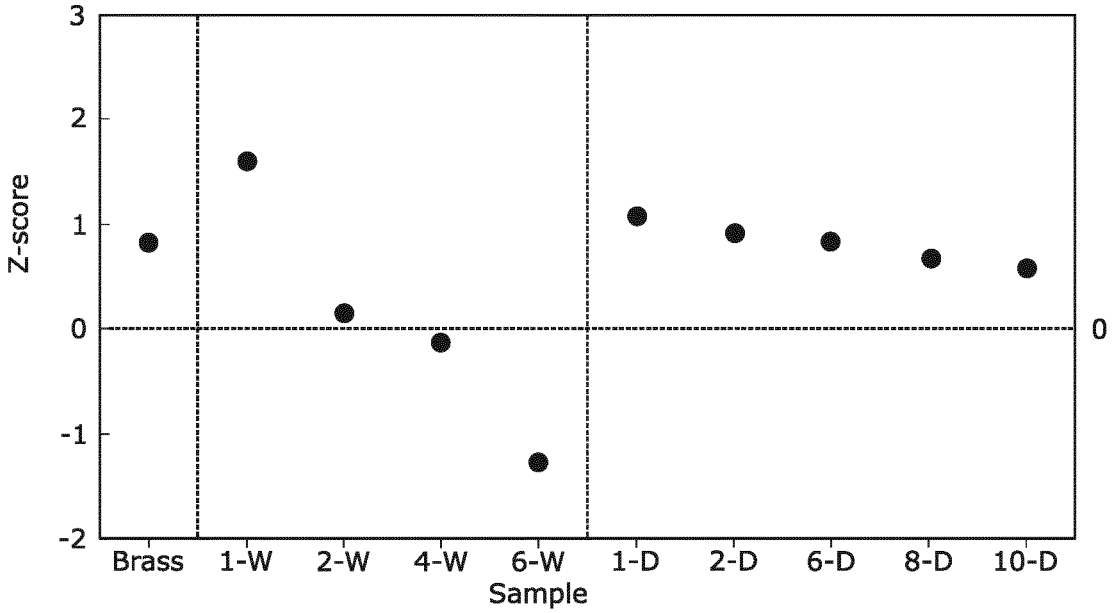

FIG. 3*a* shows the pull out force adhesion results as obtained in Family II compounds in under cure vulcanisation conditions.

Figure 3B:
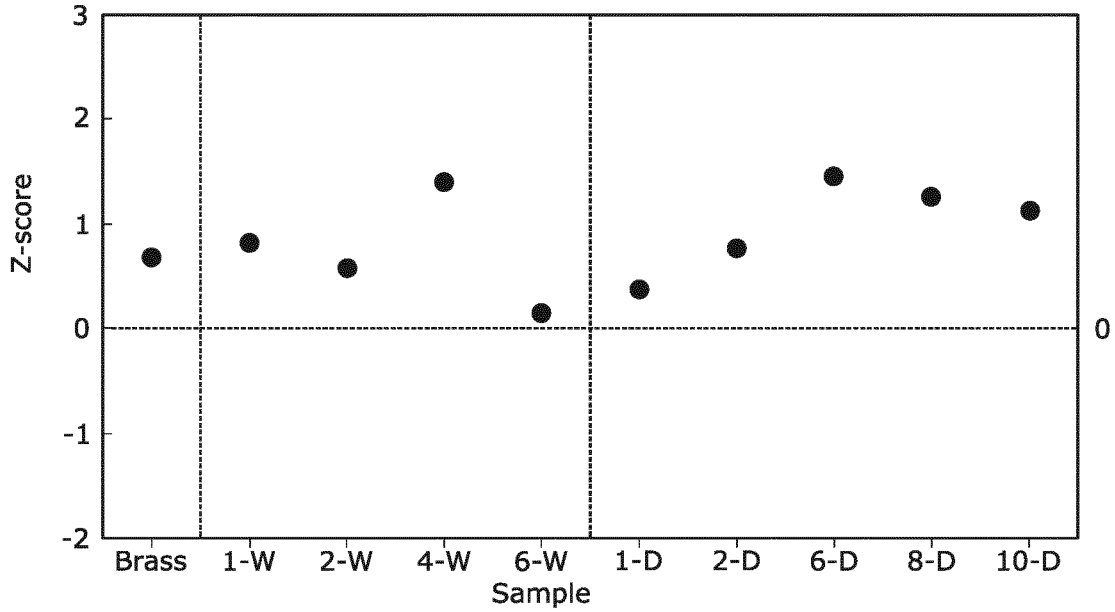

FIG. 3*b* shows the pull out force adhesion results as obtained in Family II compounds in regular cure vulcanisation conditions.

Figure 3C:
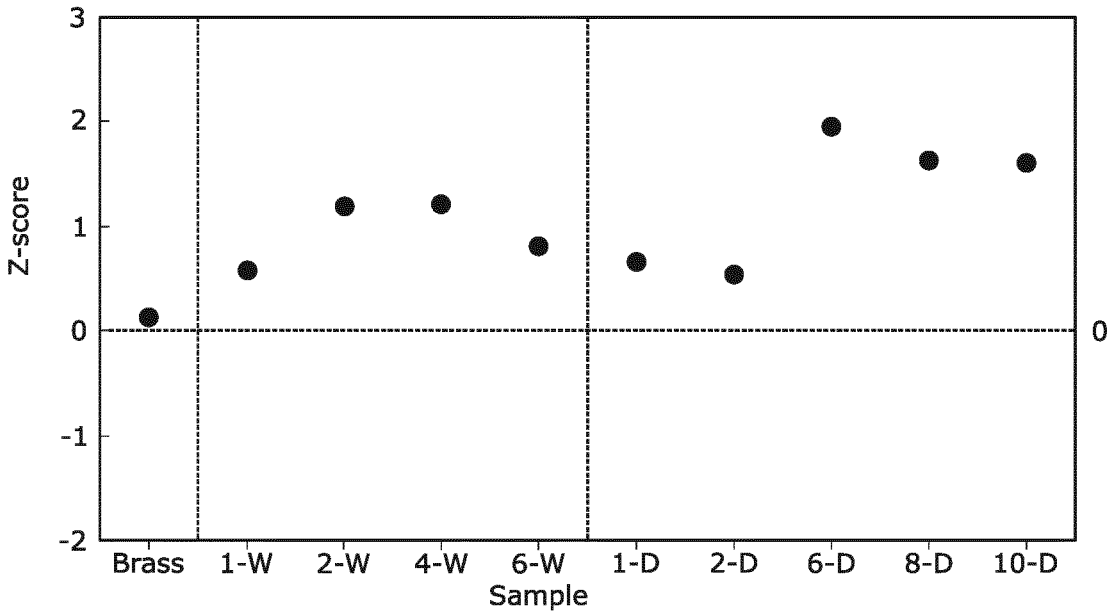

FIG. 3*c* shows the pull out force adhesion results as obtained in Family II compounds in over cure vulcanisation conditions.

Figure 3D:
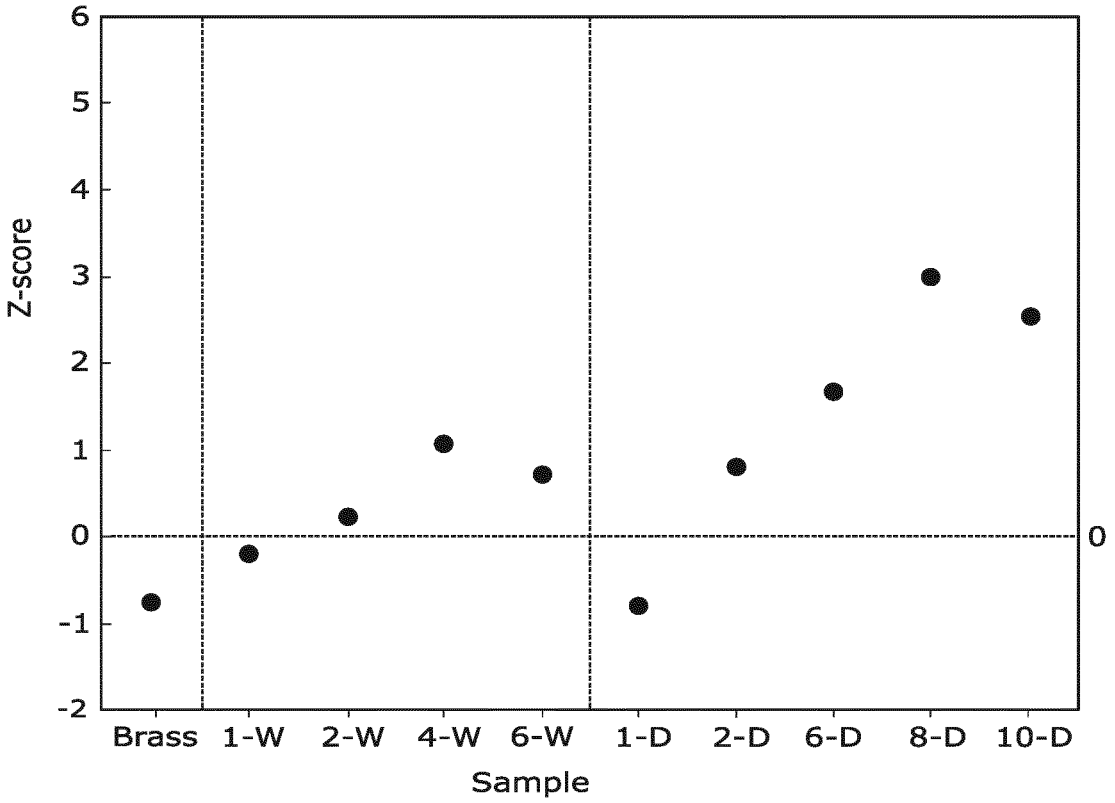

FIG. 3*d* shows the pull out force adhesion results as obtained in Family II compounds after cured humidity aging.

Figure 3E:
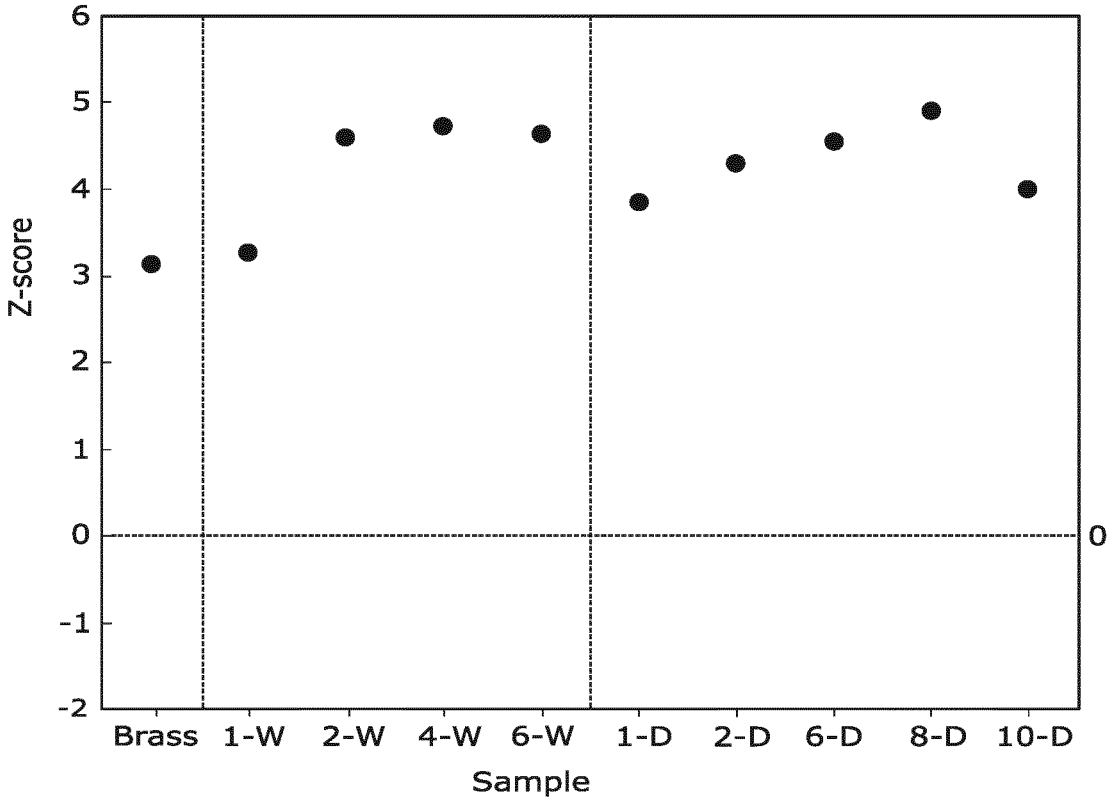

FIG. 3*e* shows the pull out force adhesion results as obtained in Family II compounds after steam aging.

Family I compounds are five different compounds that contain an organic cobalt salt as is currently used in the industry. Family II compounds are five different compounds that are free of added cobalt.

Each point in FIGS. 2*a* to 2*e*, FIGS. 3*a* to 3*e* represents the average of five different compounds within the respective Family according the different vulcanisation conditions (a to c) or aging conditions (d to e).

In FIGS. 2*a* to 2*e*, and 3*a* to 3*e* the reference value '0' is the average of regular brass coated steel cord of which the filaments are drawn in Set W dies as obtained on Family I compounds.

MODE(S) FOR CARRYING OUT THE INVENTION

The invention has been implemented on a 3×0.28 Super Tensile construction. With 'Super Tensile' is meant that the tensile strength of a single filament is at least 3265 N/mm$^2$ with a target value of 3440 N/mm$^2$.

The filament was prepared as follows:

Steel wire rod of class 0.80C was selected meaning that the steel has a minimum carbon content of 0.80 wt % carbon and a maximum carbon content of 0.85 wt %. Other elements were present according the specifications, this patent application (plain carbon steel composition). The steel wire was dry drawn to a diameter of 1.98 mm;

This steel wire was duly patented by first heating the wire to above 950° C. in order to reach full austenisation. Subsequently the wire was cooled down in a water-air-water patenting installation as known in the art. This is the 'intermediate steel wire having an intermediate diameter' as per the method claims;

This intermediate steel wire was electroplated with a copper layer by guiding the wire through a copper pyrophosphate bath containing complexes of $Cu^{2+}$ cations and $P_2O_7^{4-}$ anions in an aqueous alkaline bath consisting of $Cu^{2+}$ with concentration in the range of 22 to 38 g/L, pyrophosphate ($P_2O_7^{4-}$) in a concentration range of 150 to 250 g/L, nitrate $NO_3^-$ in a concentration range of 5 to 10 g/L and ammonia $NH_3$ in a concentration of 1 to 3 g/L. The bath is run at a pH of 8.0 to 9.0 and the current density is held between 1 to 9 A/dm$^2$. The amount of copper deposited is adjusted in function of the desired final coating composition;

The copper coated intermediate wire is subsequently guided through a ferrous sulfamate ($Fe(OSO_2NH_2)_2$) solution with a composition along following lines: 75 g/L of iron(II), ammonium sulfamate in a concentration range of 30 to 38 g/L, sodium chloride 37 to 45 g/L at a pH of between 2.7 to 3.0, a temperature of 50 to 60° C. and a current density of 5 to 6 A/dm$^2$. The amount of iron deposited is adjusted in function of the desired final coating composition The use of a ferrous sulfamate electrolyte solution results in a stable and well controllable bath;

The copper-iron coated intermediate wire is subsequently guided through an aqueous zinc sulphate ($ZnSO_4.7H_2O$) bath containing between 40 to 90 g/L of zinc at a pH of between 3 to 3.7. The zinc layer is deposited with a current density of between 20 to 30 A/dm$^2$;

The copper-iron-zinc coated intermediate wire is subsequently subjected to heat by means of a mid frequent heating stage, followed by a temperature insulation zone. Care has been taken that the temperature does not rise above 530° C. in order to prevent the formation of hard iron-zinc alloys. The resulting wire is an intermediate steel wire with a brass coating enriched with iron particles;

In a next stage the zinc oxide and iron oxide formed during the heat treatment is removed by means of a phosphoric acid dip. Depending on the immersion time and cleaning the amount of phosphorous present on the surface can be modulated;

In a first design of experiments a coating composition of 62, 64, 66, 68 wt % Cu in combination with iron contents of 1, 2, 3, 4, 5 wt % Fe were combined, the remainder being zinc. Weight fractions are relative to the total coating amount. The results showed that best adhesion results were obtained with higher Fe concentrations. Therefore a second design of experiments was launched with even higher iron contents.

In a second design of experiments the following compositions and coat weights were obtained on the intermediate steel wire with a brass coating enriched with iron particles (Table I):

TABLE I

| Sample | Copper (wt %) | Iron (wt %) | Zinc (wt %) | Total (g/kg) | Cu/ (Cu + Zn) (wt %) |
|---|---|---|---|---|---|
| Ref. | 62.5 | — | 37.5 | 4.28 | 62.5 |
| S64-1 | 64.1 | 1.2 | 34.6 | 4.12 | 64.9 |
| S64-2 | 63.9 | 2.4 | 33.8 | 4.17 | 65.4 |
| S64-4 | 64.5 | 4.0 | 31.4 | 4.135 | 67.2 |
| S64-6 | 64.2 | 6.6 | 29.3 | 4.17 | 68.7 |
| S64-8 | 63.1 | 9.4 | 27.5 | 4.14 | 69.7 |
| S64-10 | 62.5 | 11.7 | 25.7 | 4.21 | 70.8 |

'Ref' is the reference that is a brass coated wire without intended addition of iron. Inventive wires are indicated with leading 'S'.

Dissolution of the coating on the intermediate steel wire according Procedure 1 revealed the presence of iron particles. An X-Ray Diffractogram revealed that no beta (β)—brass peak was present at a two theta (2θ) angle of 43.3° where one would expect a peak when beta—brass would be present and this for all inventive samples.

Thereafter the intermediate wire with a brass coating enriched with iron particles is drawn to a final diameter of 0.28 mm by wet wire drawing the wire through subsequently smaller dies in a lubricant. The lubricant contains high pressure additives that generally comprise phosphorous in organic compounds. Two types of dies were compared during wet wire drawing:

Set W: all drawing dies are tungsten carbide dies; inclusive the last three dies of which the last one is the head die;

Set D: At least the head die is a sintered diamond die, the remainder of the dies being tungsten carbide dies.

The total true elongation applied to the intermediate steel wire with a brass coating enriched with iron particle is thus 3.91.

When considering an iron particle in the brass coating of the intermediate wire, this particle is subjected to an elongation of $(D/d)^2$ in the direction of the wire i.e. the longitudinal direction. At the same time the particle is compressed in radial and circumferential direction, both with a factor of (d/D). This under the assumption that iron is not compressible. This implies that iron particles present in the intermediate wire of 1.98 mm are elongated by a factor of about 50 when drawn to a diameter of 0.28 mm. As iron cannot sustain such a high elongation the larger particles of the intermediate wire are milled, minced, broken up into particles with size between 10 nm and 10 000 nm as could be verified by the Procedure 1 describe above.

FIG. 1*a* shows the surface of the filament 564-8-D after removal of the brass in a Scanning Electron Microscope (SEM). Various iron particles 102 (7.5 μm), 102' (6.8 μm), 102" (8.5 μm), 104 (1.0 μm), 104' (1.0 μm) are detectable that have been pushed onto the filamentary substrate. The size of the particles—thereby taking the points that are furthest away from one another is at the most 8.5 μm.

The smaller iron particles (104, 104') may even be smaller than the noted size of 1.0 μm when other techniques such as high angle annular dark field, scanning transmission electron microscopy (HAADF-STEM) are used. Particles with a size of 120 nm can be detected inside the brass coating: see FIG. 1*b* that shows the concentration of iron in the coating. An iron particle—indicated by the arrow—is visible. The dotted line has been added to make the outer border of the coating better visible.

There appears to be a correlation with the size of the largest particles with the amount of iron incorporated into the brass coating of the intermediates steel wire: the more iron is incorporated, the larger the particles appear to be.

Three steel filaments were twisted into a 3×0.28 ST cord and the surface residues of phosphorous and iron were measured of the resulting cord as per Procedure 3. The results are represented in Table II:

TABLE II

| Sample | $P_s$ (mg/m$^2$) | $Fe_s$ (mg/m$^2$) | $Fe_s/P_s$ | SCW (g/m$^2$) | $Fe_s$/ (SCW × $P_s$) |
|---|---|---|---|---|---|
| Ref-W | 1.5 | 36.2 | 24.0 | 2.15 | 11.2 |
| S64-1-W | 1.5 | 32.2 | 21.1 | 2.13 | 9.9 |
| S64-2-W | 1.7 | 38.4 | 22.6 | 2.09 | 10.8 |
| S64-4-W | 1.9 | 43.2 | 22.4 | 2.01 | 10.8 |
| S64-6-W | 2.6 | 52.3 | 20.3 | 2.11 | 9.6 |
| S64-1-D | 0.8 | 34.3 | 41.9 | 2.00 | 21.0 |
| S64-2-D | 0.8 | 34.5 | 42.1 | 1.98 | 21.2 |

TABLE II-continued

| Sample | $P_s$ (mg/m$^2$) | $Fe_s$ (mg/m$^2$) | $Fe_s/P_s$ | SCW (g/m$^2$) | $Fe_s$/(SCW × $P_s$) |
|---|---|---|---|---|---|
| S64-6-D | 1.0 | 35.7 | 35.8 | 1.96 | 18.3 |
| S64-8-D | 1.5 | 46.9 | 31.3 | 1.98 | 15.8 |
| S64-10-D | 1.9 | 55.5 | 29.5 | 1.91 | 15.4 |

Ref-W is the reference that is a brass coated wire without iron particles drawn in Set W dies.

From Table II it is clear that Set W dies result in more phosphorous as well as more iron at the surface. Set D dies result in a lower phosphorous and iron concentration for the same iron added to the coating. The ratio $Fe_s/P_s$ is always above 27 for filaments drawn with Set-D drawing dies. When using the ratio $(Fe_s/SCW)/P_s$ the difference is even more clearcut and the relative range of the values is more reduced. All the values of Set D drawn wires have this ratio above 14 and even 15 while the Set W drawn wires have this ratio below 13 and even below 11.

In the series of FIGS. 2*a* to 2*e*, 3*a* to 3*e* the adhesion results of the different samples of Table II in five compounds of Family I (that contain organic cobalt salts) and Family II (that are free of intentionally added cobalt) are represented. Adhesion results are pull-out forces as determined according to the ASTM D2229-04 standard, as further detailed in the BISFA ("The International Bureau for Standardisation of Man-made fibres") brochure 'Internationally agreed methods for testing of steel tyre cord' 1995 Edition, "D12 Determination of static adhesion to rubber compounds" according to the conditions given (under cure, regular cure, over cure). In this test steel cords are embedded in a block shaped rubber and pulled out of the rubber along the axial direction after vulcanisation. The maximum force (in N) attained is noted. The average of 24 individual maximum forces (in N) is noted as the 'Pull-Out Force' (POF).

For each one of the ten compounds the conditions for regular cure (RC) were set as the TC90 time plus 5 minutes, TC90 being that time where the particular rubber reaches 90% of its maximum torque on a rheometer curve taken at the vulcanisation temperature. 'Over cure' condition (OC) occurs when the rubber is vulcanised well over its normal cure time in this application twice as long as the regular cure time. Under cure (UC) vulcanisation is done by vulcanising the rubber only half of the regular cure time.

In order to establish the adhesion retention the following aging conditions are applied to RC cured samples:

After Cured Humidity (CH): RC samples are held at 93° C. in a 95% relative humidity environment for 14 days After Steam Aging (SA): in which RC samples are steam cooked at 120° C. for 2 days.

In what follows any one of the vulcanisation conditions UC, RC or OC or any one of the aging conditions CH or SA will be referred to as a 'Condition'.

The results of the adhesion tests are represented as a Z-score deviation from the Reference Average (RA') in the FIGS. 2*a* to 2*e* and 3*a* to 3*e*. The Reference Average RA—indicated with '0' in all figures—is equal to the weighted average of the Ref-W sample in all cobalt containing compounds of Family I and this for the particular Condition as per that figure. The statistical standard deviation of all results obtained on the Ref-W sample in the Family I compounds in the particular Condition is calculated and called Reference Standard Deviaton ('RSTD') for that condition. In short: the reference is the known brass (Ref-W sample)—cobalt containing rubber system (Family I) in each of the Condition mentioned in the figure's caption.

For each of the Families I and II and for each of the samples ('Samples') of Table II the Pull-Out Force has been determined for each Condition. The Pull-out Forces are weight averaged to a Sample Average ('SA') and the statistical standard deviation calculated, referred to as the Sample Standard Deviation, ('SSTD') for that Family and Condition.

The Z-score of a Sample in a Family of compounds for a certain Condition is then equal to the difference between the Sample Average for that Family and Condition minus the Reference Average for that Condition divided by the pooled standard deviation of the Reference Standard Deviation and Sample Standard Deviation. In short:

$$Z = \frac{SA - RA}{\sqrt{\frac{((N_S - 1)SSTD^2 + (N_R - 1)RSTD^2)}{N_S + N_R - 2}}}$$

Wherein $N_S$ is the number of results pooled to obtain SA and SSTD and $N_R$ is the number of results pooled to obtain RA and RSTD.

The Z-score indicates in how for the deviations from the averages are statistically significant from the Reference Average i.e. the current state of the art in the particular Family, Condition the Sample has been tested:

Z-scores that are below '−2' indicate statistically significant deterioration compared to the Reference Average;

Z-scores between −2 and −1 are indicative for a possible deterioration but are not statistically significant;

Z-scores between '−1' and '+1' indicate that no statistical significant deterioration or improvement to the Reference Average can be inferred;

Z-scores between +1 and +2 are indicative for a possible improvement but that is not statistically significant;

Z-scores above +2 represent a statistically significant improvement to the current state of the art.

With regard to the Family I i.e. cobalt containing compounds the following conclusions can be drawn:

FIG. 2*a*: in under cure condition the presence of iron particles in the brass coating . . .

. . . does not result in a statistically significant improvement or deterioration compared to the Reference Average when Set-W dies are used;

. . . may lead to an improvement compared to the Reference Average when Set-D dies are used;

Best results in UC conditions are obtained when a lower amount of iron is incorporated into the coating.

FIG. 2*b*: in regular cure conditions the presence of iron particles in the brass coating . . .

. . . does result in an improvement that is not significant when Set-W dies are used.

. . . does result in an improvement when Set-D dies are used.

However, the improvement is not statistically significant. The amount of iron particles incorporated does not have a significant influence.

FIG. 2*c*: in overcure conditions the presence of iron particles in the brass coating does not lead to statistically improved results compared to the current state of the art. However, there are no indications that the invention would lead to a deterioration: all Z-scores are positive throughout.

FIG. 2*d*: After cured humidity conditioning the use of the invention results in a statistically significant improvement when a higher amount of iron (8 wt % to 10 wt %) is incorporated into the brass coating while using Set-D dies. On other samples there is no significant improvement. In general the use of the invention does not result in deteriorated results.

FIG. 2*e*: the invention results in a high, statistically significant improvement of the adhesion retention results after steam aging when Set-D dies are used. The results even further improve with increased iron content in the coating. Use of Set-W dies does lead to an improvement but it is not statistically significant.

The inventors conclude that their invention can be used in exchange with currently used steel cord in currently used cobalt containing compounds without facing any risk of possibly inferior adhesion results or increased adhesion retention problems. On the contrary: when using Set-D dies adhesion retention results after steam aging are highly and statistically significantly improved.

With regard to the Family II i.e. compounds that are free of intentionally added cobalt the following conclusions can be drawn:

FIG. 3*a*: in under cure the invention results in no significant improvement or deterioration compared with the state of the art (that is: brass coated Set-W drawn steel cord in cobalt containing compounds). In general there is slight tendency that increased iron content may lead to lower under cure results. The trend is less outspoken when Set-D dies are used.

FIG. 3*b*: in regular cure condition the Z-scores are all positive indicating that no adverse effect of the invention is to be expected. The improvements are not statistically significant.

The same conclusions can be drawn for over cure results as represented in FIG. 3*c*: the inventive steel cord is better but the improvement is not statistically significant.

FIG. 3*d*: the invention shows a statistically significant improvement in the cured humidity results for higher iron contents (6 wt %, 8 wt % and 10 wt %) and when Set-D drawing dies are used. The other results remain statistically not significant.

FIG. 3*e*: the invention shows a marked and statistically significant improvement over the prior art for both Set-W and Set-D dies in after steam aging condition. There is a clear indication that an increased content of iron in the coating leads to increased results, but only up to 8 wt % of iron.

In FIGS. 3*a* to 3*e*: 'Brass' refers to the results obtained with Set-W reference wires when tested in Family II compounds.

In conclusion it has been demonstrated that the incorporation of iron particles in a brass coating leads to improved adhesion retention in compounds that are free of intentionally added cobalt as well as in compounds that do contain cobalt.

The invention has been particularly made for reinforcing rubber products such as tires, hoses or belts, for totally eliminating the presence of cobalt in the rubber as well as in the steel cord coating.

The invention claimed is:

1. A steel cord comprising one or more filaments, said filaments comprising a steel filamentary substrate and a coating partly or totally covering said steel filamentary substrate, said coating comprising brass consisting of copper and zinc, said coating being enriched with iron, wherein said iron is present as particles in said brass, said particles having a size between 10 and 10 000 nanometer.

2. The steel cord according to claim 1 wherein said particles have a size between 20 and 5000 nanometer.

3. The steel cord according to claim 1 wherein said brass comprises at least 63% of copper by mass, the remainder being zinc.

4. The steel cord according to claim 1 wherein the amount of iron in said coating is greater than or equal to 1% in mass and is smaller than 10% in mass compared to the total mass of brass and iron.

5. The steel cord according to claim 4 wherein the amount of iron in said coating is greater than or equal to 3% in mass and is smaller than 9% in mass compared to the total mass of brass and iron.

6. The steel cord according to claim 1 wherein said coating is substantially free of zinc iron alloy.

7. The steel cord according to claim 1 wherein the amount of phosphorous present at the surface of said filament is $P_s$ and wherein the amount of iron present at the surface of said filament is $Fe_s$, said $P_s$ and $Fe_s$ being determined by the $P_s$ and $Fe_s$ Procedure 3 as defined in the description and expressed in milligram per square meter, said $P_s$ being smaller than or equal to 4 mg/m$^2$ and larger than zero.

8. The steel cord according to claim 7 wherein the amount of iron present at the surface $Fe_s$ is larger than or equal to 30 mg/m$^2$.

9. The steel cord according to claim 7 wherein the ratio of $Fe_s$ over $P_s$ is larger than 27.

10. The steel cord according to claim 7 wherein the surface coating weight SCW is the sum of the mass of brass and iron present in said coating per unit of surface area, said coating weight being expressed in grams per square meter wherein the ratio of $Fe_s$ over the product of $P_s$ and coating weight SCW is larger than 13.

11. The steel cord according to claim 1 wherein said steel cord consists of a single filament.

12. A rubber product comprising vulcanized rubber reinforced with a steel cord according to claim 1 wherein said rubber product is one out of the group consisting of tire, passenger car tire, truck tire, van tire, off-the-road tire, hose, hydraulic hose, belt, synchronous belt, conveyor belt, elevator belt.

13. The rubber product according to claim 12 wherein said vulcanized rubber is substantially free of cobalt.

* * * * *